US006832408B2

(12) United States Patent
Roney et al.

(10) Patent No.: US 6,832,408 B2
(45) Date of Patent: Dec. 21, 2004

(54) CADDY FOR VACUUM CLEANER TOOL AND ACCESSORIES

(75) Inventors: Jeffrey T. Roney, Stanford, KY (US); Eric E. Muhlenkamp, Danville, KY (US)

(73) Assignee: Matsushita Electric Corporation of America, Secaucus, NJ (US)

( * ) Notice: Subject to any disclaimer, the term of this patent is extended or adjusted under 35 U.S.C. 154(b) by 252 days.

(21) Appl. No.: 10/106,920

(22) Filed: Mar. 25, 2002

(65) Prior Publication Data

US 2003/0024067 A1 Feb. 6, 2003

Related U.S. Application Data

(60) Provisional application No. 60/309,623, filed on Aug. 2, 2001.

(51) Int. Cl.[7] ..... A47L 9/00; A47L 9/24

(52) U.S. Cl. ..... 15/323; 220/735; 206/373

(58) Field of Search ..... 15/323; 206/372, 206/373; 220/735, 694; D32/31, 32

(56) References Cited

U.S. PATENT DOCUMENTS

| | | | | | |
|---|---|---|---|---|---|
| 2,340,390 | A | * | 2/1944 | Kitto | 206/361 |
| 2,738,101 | A | * | 3/1956 | Vander Ven | 220/735 |
| D295,910 | S | | 5/1988 | Hill | |
| D329,511 | S | | 9/1992 | McKnight | |
| D330,616 | S | | 10/1992 | Wareham et al. | |
| D333,020 | S | | 2/1993 | McKnight | |
| D334,260 | S | | 3/1993 | Kieft et al. | |
| D344,821 | S | | 3/1994 | McKnight | |
| 5,331,715 | A | * | 7/1994 | Johnson et al. | 15/332 |
| D363,163 | S | | 10/1995 | Funatsu et al. | |
| D381,482 | S | | 7/1997 | Medema et al. | |
| D383,882 | S | | 9/1997 | Medema | |
| D391,703 | S | | 3/1998 | Miller et al. | |
| D426,358 | S | | 6/2000 | Saunders et al. | |
| D434,886 | S | | 12/2000 | Wareham et al. | |
| 6,260,233 | B1 | * | 7/2001 | Wareham et al. | 15/323 |
| D463,079 | S | * | 9/2002 | Leyden | D32/31 |
| 6,536,590 | B1 | * | 3/2003 | Godshaw et al. | 206/373 |

* cited by examiner

*Primary Examiner*—Robert J. Warden, Sr.
*Assistant Examiner*—Laura C Cole
(74) *Attorney, Agent, or Firm*—King & Schickli, PLLC

(57) ABSTRACT

A two-piece caddy and vacuum cleaner accessory assembly is provided. The caddy includes first and second body sections that are connected together without the use of a separate independent fastener. The first body section includes first, second and third accessory receptacles. The second body section includes first, second and third accessory engaging clips. The receptacles and clips function to hold various vacuum cleaner tools and accessories such as an extension hose, a wand, a crevice cleaning tool and a nozzle brush.

11 Claims, 5 Drawing Sheets

CADDY FOR VACUUM CLEANER TOOL AND ACCESSORIES

This application claims the benefit of U.S. Provisional Patent Application Ser. No. 60/309,623 filed Aug. 2, 2001.

TECHNICAL FIELD

The present invention relates generally to a caddy for vacuum cleaner tools and accessories.

BACKGROUND OF THE INVENTION

Upright vacuum cleaners in all of their designs and permutations have become increasingly popular over the years. Today's upright vacuum cleaners generally incorporate a nozzle assembly which rides on wheels over the floor surface to be cleaned. A canister assembly is pivotally mounted to the nozzle assembly. The canister assembly includes an operating handle that is manipulated by the user to move the vacuum cleaner to and fro across the floor. The canister assembly also includes either a bag-like filter or a cyclonic separation chamber and filter combination to trap dirt and debris while substantially clean air is exhausted by a fan that is driven by an onboard electric motor. It is this fan and motor arrangement that generates the drop in air pressure necessary to provide the desired cleaning action. In most upright vacuum cleaners sold today, a rotary agitator is also provided in the nozzle assembly. The rotary agitator includes tufts of bristles, brushes, beater bars or the like to beat dirt and debris from the nap of a carpet being cleaned while the pressure drop or vacuum is used to force air entrained with this dirt and debris into the nozzle of the vacuum cleaner.

One of the foremost attributes of upright vacuum cleaners is the fact that they are user friendly. They provide thorough and efficient cleaning and generally may be easily directed and controlled to clean the work area. Most individuals find them easier to manipulate than canister vacuum cleaners when cleaning a floor. More specifically, many individuals find that canister vacuum cleaners are a nuisance to drag along behind them as they clean a work area.

In order to add to the versatility of upright vacuum cleaners and also to eliminate the need for having both an upright and canister vacuum cleaner, many upright vacuum cleaners are now equipped with various tools and cleaning accessories such as extension hoses, wands, upholstery brushes and crevice cleaning tools. These tools and accessories allow the upright vacuum cleaner to be converted to complete special cleaning applications such as the cleaning of furniture and draperies and hard-to-reach areas where the size of the upright vacuum cleaner would otherwise prevent cleaning.

Of course, user convenience considerations require that the tools and accessories be quickly and conveniently available to the upright vacuum cleaner operator. Accordingly, many upright vacuum cleaners are provided with tool storage compartments that are generally built in to the canister assembly. Still others are provided with removable caddies that hold the various tools and cleaning accessories. Such caddies may be mounted and carried on the housing of the upright vacuum cleaner or removed and stored at a remote location as desired by the operator.

Removable caddies known in the art are typically molded from lightweight plastic materials. These caddies include various resilient clips, receptacles and specially shaped relief features specifically sized, shaped and adapted to hold the tools and cleaning accessories. Accordingly, it has been necessary in the past to make these caddies from multiple sections which are secured together by various fasteners, usually in the form of rivets or screws. As a result, removable caddies have generally been relatively expensive to produce.

SUMMARY OF THE INVENTION

In accordance with the purposes of the present invention as described herein, a novel two-piece caddy for holding vacuum cleaner tools and accessories is provided. Advantageously, the two-piece caddy holds all the tools and accessories necessary to convert an upright vacuum cleaner, or for that matter an extractor, for specialized cleaning tasks such as the cleaning of upholstery, drapes, furniture and hard-to-reach areas requiring a wand and a crevice cleaning tool or small brush. The caddy is relatively inexpensive to produce as it only requires the molding of two sections which may be reliably snapped together and secured without the use of a separate fastener.

The two-piece caddy comprises a first body section including at least one accessory receptacle and a second body section including at least one accessory engaging clip. The two body sections are secured together by a fastenerless connection. In one embodiment, one of the first and second body sections includes a handle. Additionally, one of the first and second body sections includes a substantially keyhole shaped aperture. This aperture allows for the hanging of the caddy on a nail or hook which may be secured in the wall, for example, in a closet at a convenient height and location for storage of the caddy when not in use on the upright vacuum cleaner.

In accordance with another aspect of the present invention, a vacuum cleaner mounting lug is provided on one of the first and second body sections. The mounting lug may be provided with an air port. In this way the lug may be positioned over an intake port or exhaust air vent and, for example, held in place by a bracket. There the lug helps to reduce vacuum cleaner port/vent noise while simultaneously allowing the free passage of the air.

Either of the first and second body sections may also include a vacuum cleaner mounting tab. In one preferred embodiment the mounting lug is provided adjacent a first end of the caddy while the mounting tab is provided adjacent a second opposite end of the caddy. The mounting lug may include four walls. The mounting lug is received in a cooperating recess formed in the housing of the upright vacuum cleaner. Together, the mounting tab and mounting lug provide two mounting points at opposite ends of the caddy that secure the caddy in position on the upright vacuum cleaner. Positive connection is further ensured by including a detent on the caddy for engaging a cooperating lip formed on the vacuum cleaner body.

The first and second body sections are secured together by a plurality of fastening tabs on one of the sections and a cooperating plurality of fastening notches for receiving the fastening tabs on the other of the sections. The fastening tabs may be dovetailed and extend outwardly in different planes such as perpendicular planes in order to provide a secure connection between the two sections without the use of any separate fastener components.

In accordance with still another aspect of the present invention, a two-piece caddy and vacuum cleaner accessory assembly is provided. That assembly includes a first body section including first, second and third accessory receptacles and a second body section including first, second and third accessory engaging clips. The two body sections are secured together with a fastenerless connection as described above.

The assembly further includes an extension hose. The first receptacle is adapted for releasable receipt of a first end of the extension hose, the second receptacle is adapted for releasable receipt of the second end of the extension hose and the first and second engaging clips are adapted for releasable engagement of the intermediate section of the extension hose. The assembly also includes a wand. The third receptacle and third engaging clip cooperate to releaseably receive and hold the wand.

In one embodiment the assembly also includes a fourth receptacle in one of the body sections and a nozzle brush. The fourth receptacle is adapted for releasable receipt of the nozzle brush.

The assembly may also include a crevice cleaning tool adapted for releasable receipt in the end of the wand. If desired, the wand may be made of telescoping construction. Still further, the first end of the hose may include a resilient latch for securing the hose in the vacuum pathway of the upright vacuum cleaner and the first receptacle may include a cooperating lip which may be engaged by that latch when the hose is in the storage position on the caddy.

Still other objects of the present invention will become readily apparent to those skilled in this art. In the following description there is shown and described one possible embodiment of this invention, simply by way of illustration of one of the modes best suited to carry out the invention. As it will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of the specification, illustrates several aspects of the present invention, and together with the description serves to explain the principles of the invention. In the drawing.

Reference will now be made in detail to the present preferred embodiment of the invention, an example of which is illustrated in the accompanying drawing.

DETAILED DESCRIPTION OF THE INVENTION

Figure 1:
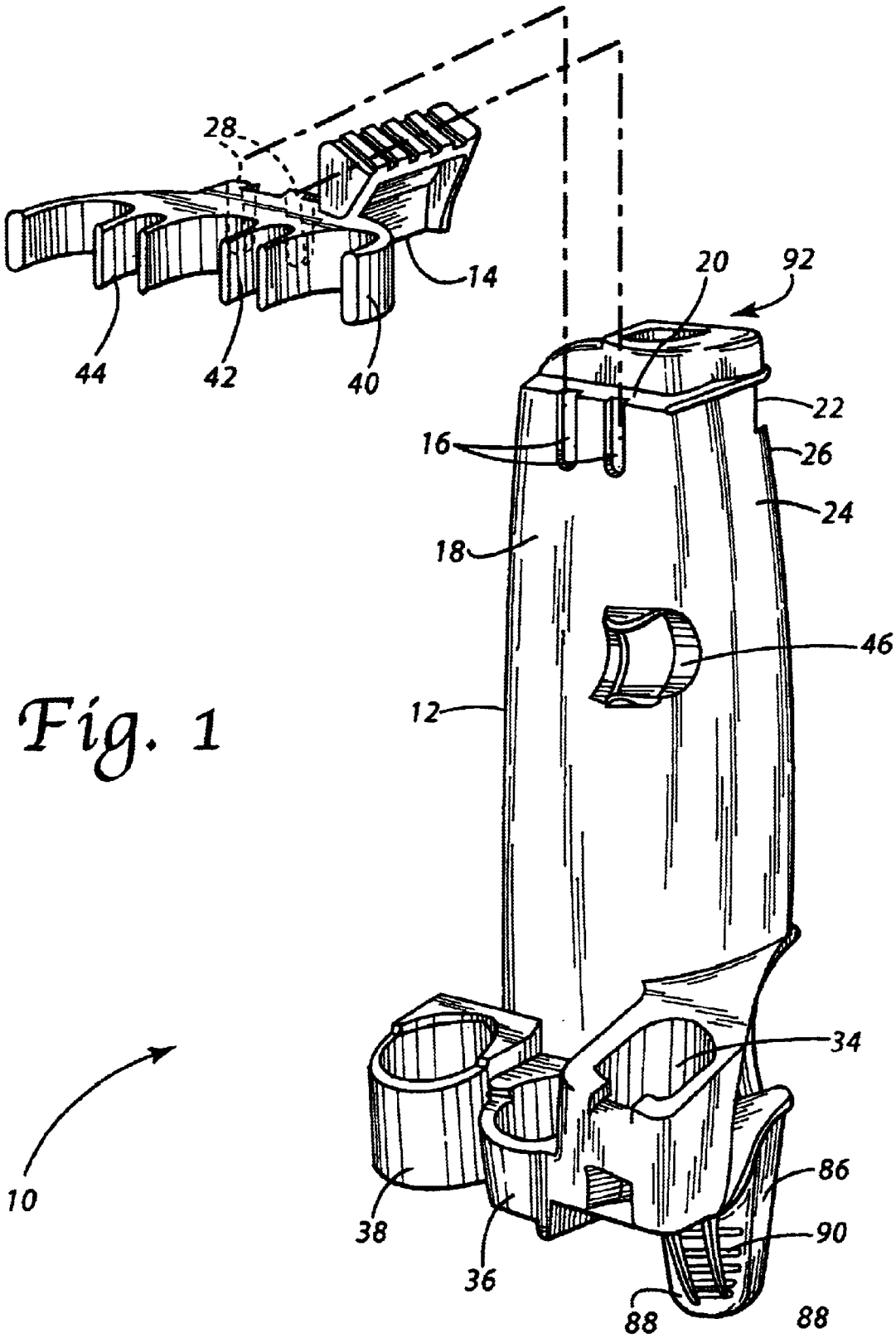
FIG. 1 is an exploded perspective view of the two-piece caddy of the present invention.

Reference is now made to FIG. 1 showing the two-piece caddy 10 of the present invention for holding various vacuum cleaner tools and accessories. The caddy 10 includes a first or lower body section 12 and a second or upper body section 14 that may be connected together without a separate, independent fastener. More specifically, the first body section 12 includes two spaced parallel fastening notches 16 formed in the front wall 18 thereof and extending as enlarged openings through the top wall 20 thereof. Additionally, another fastening notch 22 is provided in the side wall 24 thereof adjacent the edge 26.

Figure 3:
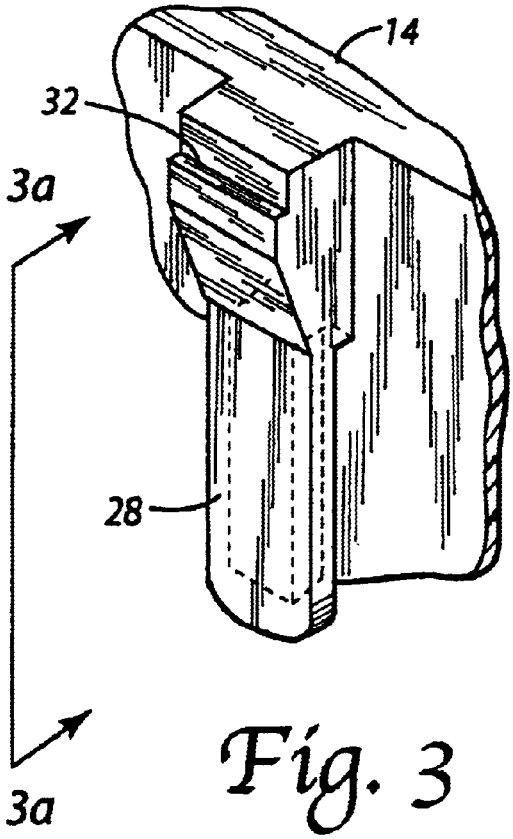
FIG. 3 is a detailed perspective view further illustrating a fastening tab on the second section of the caddy.
Figure 3A:
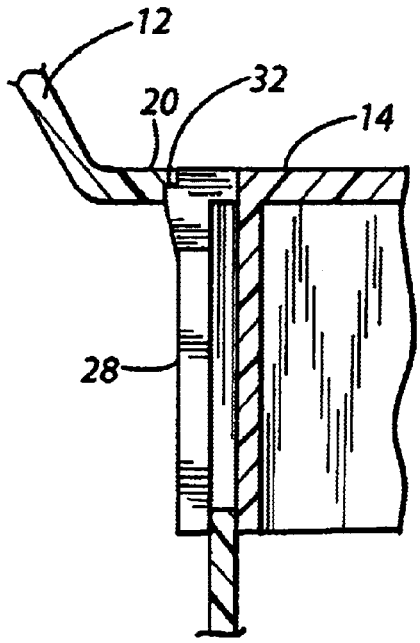
FIG. 3*a* is a detailed cross-sectional view further illustrating the engagement of one of the fastening tabs in one of the fastening notches.
Figure 2:
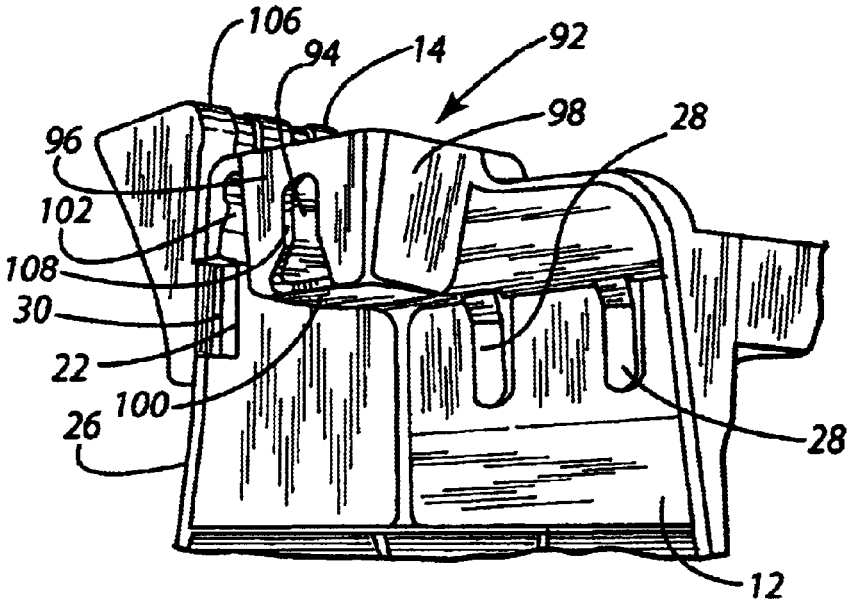
FIG. 2 is a detailed rear elevational view showing the connection of the two sections of the caddy.

The second body section 14 includes a pair of spaced fastening tabs 28 having a T or dovetail cross-section which project from the second body section in a first plane and another fastening tab 30 (as shown in FIG. 2) which projects from the second body section in a second plane perpendicular to the first plane. The first and second body sections 12, 14 are connected together by aligning and then inserting the fastening tabs 28 through the openings in the top wall 20 down into the fastening notches 16. As this is done, the second body section 14 is flexed to provide the necessary clearance to allow the fastening tab 30 to pass around the side wall 24 and edge 26 and then enter into the notch 22. A shoulder 32 (see FIG. 3*a*) formed in the top of each fastening tab 28 engages under the margin of the top wall 20 adjacent the fastening notches 16 to complete a positive snap connection and secure interconnection of the two body sections 12, 14.

Figure 4:
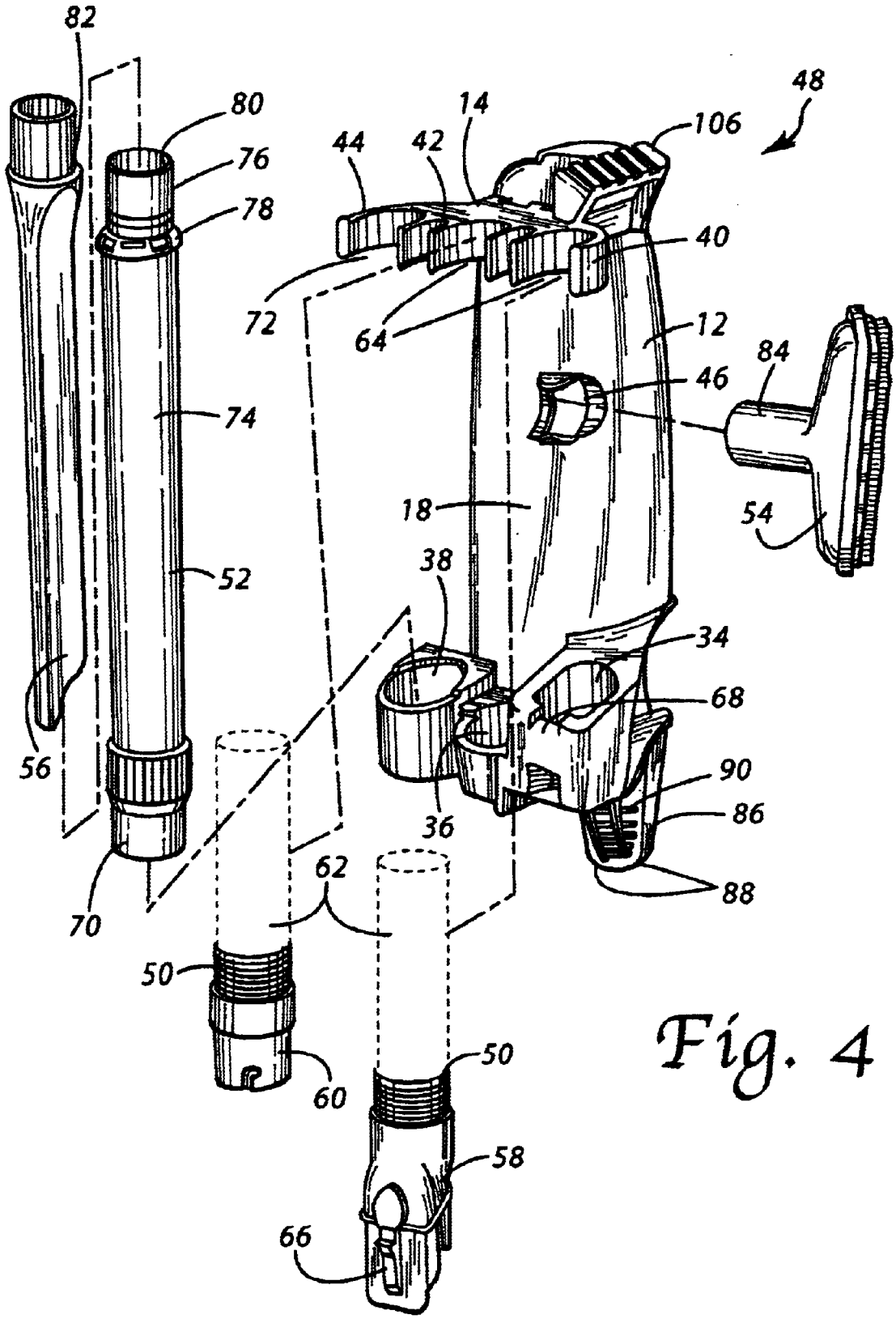
FIG. 4 is an exploded perspective view of the caddy and vacuum cleaner accessory assembly.
Figure 5:
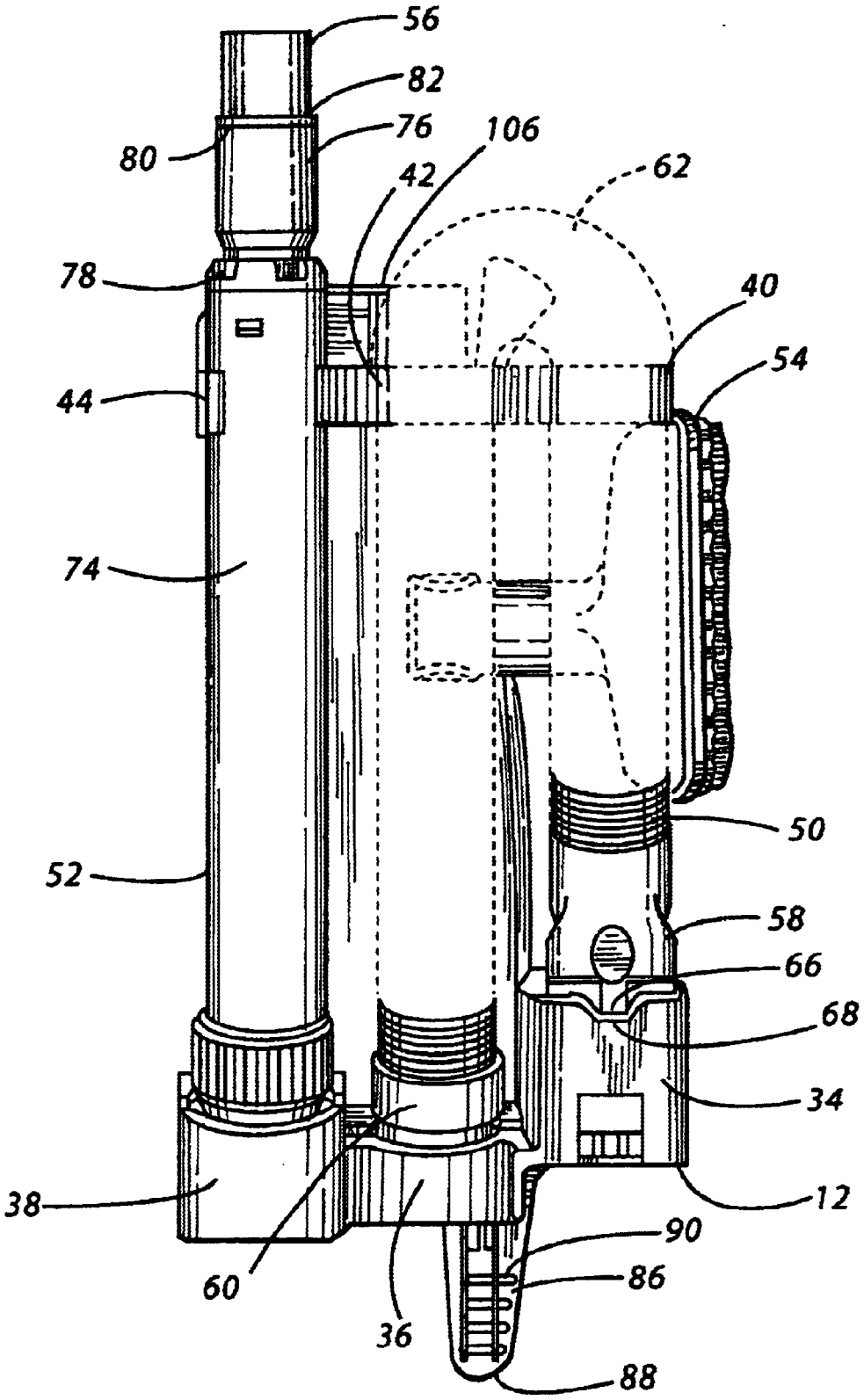
FIG. 5 is a front elevational view of the assembly shown in FIG. 4.

As best shown in FIGS. 4 and 5, the first body section 12 also includes a first accessory receptacle 34, a second accessory receptacle 36 and a third accessory receptacle 38. The second body section 14 includes a first accessory engaging clip 40, a second accessory engaging clip 42 and a third accessory engaging clip 44. As shown, the first accessory engaging clip 40 overlies the first accessory receptacle 34, the second accessory engaging clip 42 overlies the second accessory receptacle 36 and the third accessory engaging clip 44 overlies the third accessory receptacle 38. A fourth receptacle 46 formed as a recess and cooperating integral clips is formed in the front wall 18 of the first body section 12. The receptacles 34, 36, 38 and 46 and the engaging clips 40, 42 and 44 cooperate and function to hold the various cleaning tools and accessories which make up a part of the overall caddy and vacuum cleaner accessory assembly 48.

Those tools and accessories include an extension hose, generally designated by reference numeral 50, a wand 52, a nozzle brush 54 and a crevice cleaning tool 56. Each of these tools and accessories 50, 52, 54 and 56 may be mounted on the caddy 10 in the manner best illustrated in FIG. 5. More specifically, a first end 58 of the extension hose 50 is releaseably received in the first receptacle 34. A second end 60 of the extension hose 50 is releaseably received in the second receptacle 36. The intermediate section 62 of the extension hose 50 is held at two points by the first and second accessory engaging clips 40, 42. These clips 40, 42 are made of resilient plastic material which bends slightly to allow insertion of the intermediate section of the hose 50 through the openings 64 and then returns by resilient memory to its original orientation to securely and positively hold the hose in position. If the first end 58 of the extension hose 50 includes a resilient latch 66 as illustrated, the first receptacle 34 includes a lip 68 that is positively engaged by that latch when the hose 50 is properly positioned in the receptacle 34 on the caddy 10.

The wand 52 is carried on the caddy 10 by inserting a first end 70 of the wand in the third receptacle 38. The third accessory engaging clip 44 engages an intermediate portion of the wand 52. The connection is made by pressing the body of the wand 52 thorough the opening 72 of the clip 44. The resilient nature of the clip allows the opening 72 to expand so as to allow free passage of the wand into the clip. Once the wand 52 passes through the opening 72, the resilient memory of the clip causes the clip to return to its natural position closing the opening around the body of the wand 52 and thereby securing the wand in position. The wand 52 may be formed from a single tubular member or may be a telescoping wand as illustrated in the drawing figure including a first, outer tubular member 74, a second, inner tubular member 76 telescopingly received concentrically within the outer member 74 and a locking ring 78 for securing the wand in the desired telescoping position. Such a telescoping wand 52 is well known in the art.

The crevice cleaning tool 56 is carried on the caddy 10 by inserting the long, nozzle end of the tool 56 down into the lumen of the inner tubular member 76 at the second end 80 of the wand 52. More specifically, the crevice cleaning tool 56 is inserted down into the wand 52 until a stop ring 82 on the crevice tool engages the upper edge of the second end 80 of the wand. This provides a snug friction fit to hold the crevice tool 56 in position. The nozzle brush 54 is secured to and carried on the caddy by inserting the wand connection end 84 of the brush 54 into the recess in the clips of the fourth accessory receptacle 46.

Figure 6A:
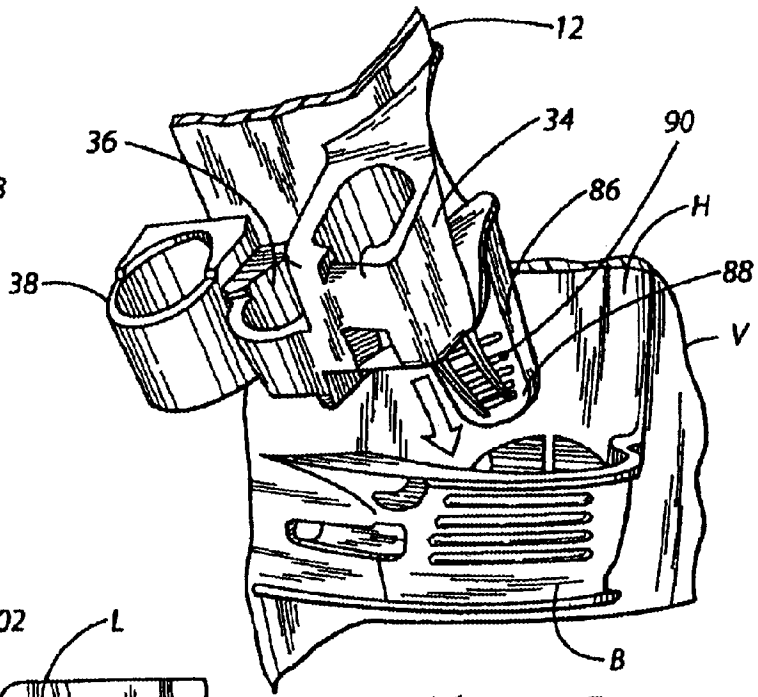
FIGS. 6*a*–6*c* are various partially cutaway views illustrating the connection of the caddy to the housing of an upright vacuum cleaner.
Figure 6B:
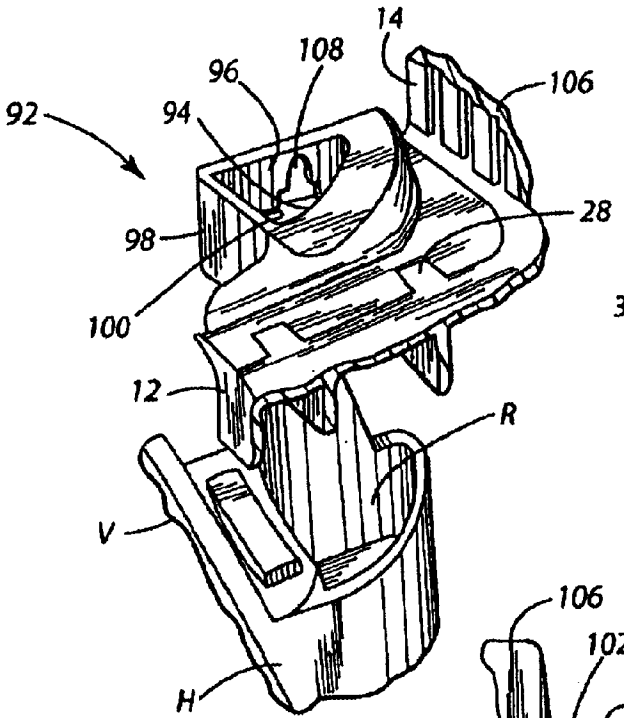
Figure 6C:
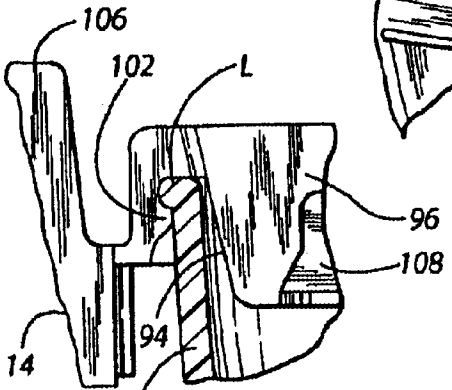

The structure for securing the caddy 10 to the canister housing H of an upright vacuum cleaner V is illustrated in FIGS. 6*a*–6*c*. As shown, the first body section 12 of the caddy 10 includes a vacuum cleaner mounting lug 86. The mounting lug 86 projects downwardly a distance A. The mounting lug 86 includes rounded corners 88 to allow easy insertion in a bracket B carried on the canister housing H. Further, the mounting lug 86 may be provided with an air port 90 in the form of a series of openings to allow the passage of air. This allows the lug to be secured over an intake port or exhaust vent of the upright vacuum cleaner without interfering with air flow.

A mounting tab 92 is provided adjacent a second opposite end of the first body section 12. The mounting tab 92 includes four walls, an arcuate front wall 94, a rear wall 96, a side wall 98 and a bottom wall 100. The mounting tab 92 projects downwardly from the upper edge of the first body section 12 a distance B where B=0.25A–0.6A. The mounting tab 92 is sized and shaped to be received in a cooperating recess R formed on the canister housing H.

As should best be appreciated from reviewing FIG. 6, caddy 10 is mounted to the vacuum cleaner V by first inserting the end of the mounting lug 86 between the bracket B and the canister housing H. The rounded corners 88 aid in aligning the parts and completing this action. Further, since the mounting lug 86 projects downwardly a distance A which is greater than the downward projection distance B of the mounting tab 92, the mounting lug 86 may be inserted behind the bracket B before having to align the mounting tab 92 with the recess R. This simplifies the connection process.

Once the mounting lug 86 is partially inserted in the gap between the bracket B and the canister housing H, the mounting tab 92 is aligned with the recess R and the caddy 10 is pushed downwardly. When the mounting lug 86 is fully engaged in the bracket B and the mounting tab 92 is fully received within the recess R, connection is completed. Secure connection is ensured by the provision of a detent 102 on the rear wall 104 of the first body section 12. When the caddy 10 is fully engaged on the vacuum cleaner V, the detent 102 engages a cooperating lip L formed on the canister housing H adjacent the recess R (see FIG. 6*c*). The caddy 10 may be easily manipulated during connection to the vacuum cleaner V and easily removed from the vacuum cleaner by engaging the handle 106 integrally molded as a part of the second body section 14.

When the caddy 10 is removed from the vacuum cleaner, the operator may wish to store the caddy at a convenient location. In an effort to accomplish this desire, the caddy 10 is equipped with a substantially keyhole shaped aperture 108. More specifically, as best shown in FIG. 1, the keyhole aperture 108 is formed in the rear wall 96 of the mounting tab 92 with the opening also extending through the bottom wall 100. The caddy may be hung on a nail or hook by passing the head of the nail or hook through the wide portion of the keyhole opening 108 in the bottom wall 100 of the mounting tab 92. The engagement of the caddy 10 on the head of the hook or nail is completed when the caddy settles down on the hook or nail under the influence of gravity and the hook or nail is received in the smaller or narrower portion of the keyhole aperture 108 (i.e. the top portion of the aperture).

In summary, numerous benefits result from employing the concepts of the present invention. A sturdy, dependable and reliable caddy 10 is provided. The caddy 10 includes the necessary receptacles 34, 36, 38 and 46 and engaging clips 40, 42 and 44 to positively and securely hold the various tools and accessories including the extension hose 50, wand 52, nozzle brush 54 and crevice cleaning tool 56 in position. Advantageously, the caddy is formed from only two sections 12, 14 that are secured together without a separate or independent fastener. This significantly reduces manufacturing costs.

The caddy 10 also allows secure yet convenient connection with a vacuum cleaner V by receipt of the mounting lug 86 in the bracket B and the nesting of the mounting tab 92 in the recess R. The different projecting lengths of the mounting lug 86 and mounting tab 92 simplifies and makes connection more convenient. The detent 102 and cooperating lip L on the vacuum cleaner V ensure a positive connection so that the caddy 10 will not come loose as the vacuum cleaner is manipulated to clean the floor. The keyhole aperture 108 provides a convenient means for mounting the caddy 10, for example, on a nail or hook in a closet at a convenient location when it is desired to remove the caddy and the accessories from the vacuum cleaner.

The foregoing description of the preferred embodiment of the invention has been presented for purposes of illustration and description. It is not intended to be exhaustive or to limit the invention to the precise form disclosed. Obvious modifications or variations are possible in light of the above teachings. For example, the various components of the two body sections 12, 14 may be reversed. The fastening notches could be provided on the first body section while the fastening tabs could be provided on the second body section. The accessory receptacles could be provided on the second body section while the accessory engaging clips could be provided on the first body section. The handle 106 could be provided on the second body section as could the mounting lug or the mounting tab, the keyhole shaped aperture or the detent.

The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed is:

1. A two-piece caddy for holding vacuum cleaner accessories, comprising:

a first piece comprising a first body section including at least one accessory receptacle; and a second piece comprising a second body section including at least one accessory engaging clip secured to said first body section without benefit of a separate fastener to complete connection of said first and second body sections;

said two-piece caddy being characterized by one of said first and second body sections including a substantially keyhole shaped aperture for hanging on a nail/hook.

2. The caddy of claim 1 wherein one of said first and second body sections includes a handle.

3. The caddy of claim 1, wherein one of said first and second body sections includes a vacuum cleaner mounting lug.

4. The caddy of claim 3, wherein said mounting lug includes an air port.

5. The caddy of claim 3, wherein one of said first and second body sections includes a vacuum cleaner mounting tab.

6. The caddy of claim 5, wherein said mounting lug is provided adjacent a first end of said caddy and said mounting tab is provided adjacent a second, opposite end of said caddy.

7. The caddy of claim 5, wherein said mounting tab includes four walls.

8. The caddy of claim 1, wherein one of said first and second body sections includes a plurality of fastening tabs and the other of said first and second body sections includes a cooperating plurality of fastening notches for receiving said plurality of fastening tabs.

9. A two-piece caddy for holding vacuum cleaner accessories, comprising:

a first piece comprising a first body section including at least one accessory receptacle; and a second piece comprising a second body section including at least one accessory engaging clip secured to said first body section without benefit of a separate fastener to complete connection of said first and second body sections;

said two-piece caddy being characterized by:

one of said first and second body sections including a vacuum cleaner mounting lug;

one of said first and second body sections including a vacuum cleaner mounting tab, said mounting tab including four walls; and a substantially keyhole shaped hanging aperture provided in one of said four walls of said mounting tab.

10. A two-piece caddy for holding vacuum cleaner accessories, comprising:

a first piece comprising a first body section including at least one accessory receptacle;

a second piece comprising a second body section including at least one accessory engaging clip secured to said first body section without benefit of a separate fastener to complete connection of said first and second body sections; and a detent on one of said first and second body sections engaging a cooperating lip formed on a vacuum cleaner body and providing positive connection of said caddy to the vacuum cleaner body.

11. A two-piece caddy for holding vacuum cleaner accessories, comprising:

a first piece comprising a first body section including at least one accessory receptacle; and a second piece comprising a second body section including at least one accessory engaging clip secured to said first body section without benefit of a separate fastener to complete connection of said first and second body sections;

one of said first and second body sections including a plurality of fastening tabs and the other of said first and second body sections including a cooperating plurality of fastening notches receiving said plurality of fastening tabs, at least one of said fastening tabs being dovetailed.

* * * * *